US007399234B2

(12) United States Patent
Geraty

(10) Patent No.: US 7,399,234 B2
(45) Date of Patent: Jul. 15, 2008

(54) GOLF PRACTICE DEVICE

(75) Inventor: Thomas Geraty, San Jose, CA (US)

(73) Assignee: Inova Products, Inc., San Jose, CA (US)

( * ) Notice: Subject to any disclaimer, the term of this patent is extended or adjusted under 35 U.S.C. 154(b) by 0 days.

(21) Appl. No.: 11/489,832

(22) Filed: Jul. 19, 2006

(65) Prior Publication Data

US 2007/0197309 A1 Aug. 23, 2007

Related U.S. Application Data

(60) Provisional application No. 60/774,393, filed on Feb. 18, 2006.

(51) Int. Cl.
*A63B 53/06* (2006.01)

(52) U.S. Cl. ..... 473/257; 101/35; 473/219

(58) Field of Classification Search ..... 473/226, 473/257, 282, 285

See application file for complete search history.

(56) References Cited

U.S. PATENT DOCUMENTS

| | | | | |
|---|---|---|---|---|
| 734,085 | A | 7/1903 | O'Mara et al. | |
| 3,006,009 | A * | 10/1961 | Hoffecker | 15/97.1 |
| 3,019,762 | A | 2/1962 | Hautz | |
| 4,553,752 | A * | 11/1985 | Bagg | 473/300 |
| 4,603,862 | A | 8/1986 | Chen | |
| 5,004,239 | A * | 4/1991 | Wettstein | 473/282 |
| 5,018,450 | A * | 5/1991 | Smith | 102/513 |
| 5,120,358 | A | 6/1992 | Pippett | |
| 5,597,361 | A | 1/1997 | Hope | |
| 6,209,452 | B1 | 4/2001 | Klimek | |
| 6,213,012 | B1 | 4/2001 | Arms | |
| 6,344,004 | B2 | 2/2002 | Adams et al. | |
| 6,585,604 | B1 | 7/2003 | Morrone | |
| 2004/0139867 | A1 | 7/2004 | Chudy | |

FOREIGN PATENT DOCUMENTS

| | | | |
|---|---|---|---|
| DE | 8501371 | U1 | 8/1985 |
| FR | 2 854 332 | A1 | 11/2004 |

* cited by examiner

*Primary Examiner*—Nini F. Legesse
(74) *Attorney, Agent, or Firm*—Rutan & Tucker, LLP

(57) ABSTRACT

A golf practice device is disclosed. In an embodiment, the golf practice device includes a first upper part and a second lower part. A hinge assembly rotatably connects the first upper part and the second lower part. The first upper part includes an interior sized to removably receive a golf ball for marking a center line on the ball. The second lower part has a base and includes an interior. Compressed powder to mark the golf ball is contained within the interior of the second lower part.

18 Claims, 12 Drawing Sheets

GOLF PRACTICE DEVICE

RELATED APPLICATIONS

This application claims priority to U.S. Provisional Patent Application No. 60/774,393, entitled "Golf Practice Device", filed Feb. 18, 2006.

FIELD

Aspects of this invention generally relate to golf teaching devices. More particularly, an embodiment of the invention relates to a portable, handheld device for marking a golf ball and thereby training a golfer to hit said golf ball with the "sweet-spot" of a golf club.

BACKGROUND

"Sweet-spot" is a colloquialism used to describe a central area on a golf-club's face. A golf ball impacted by a properly aligned sweet-spot receives a maximum velocity and optimum trajectory. The same ball, if impacted by a misaligned club head, receives a lower velocity and is more likely to be misdirected. For these reasons, golf club manufacturers tend to design clubs in ways that maximize the sweet-spot's size. Although these efforts have proven effective, the goal of each golfer remains the same—to impact the golf ball at the sweet-spot. Failure to do so frequently produces misdirected shots of questionable duration.

By way of example, a golf ball impacted by the heel of a golf club swung by a right-handed golfer tends to "pull" to the left of the intended flight path. When impacted by the toe of the golfer's club, the same ball frequently tends to "pull" to the right of the intended trajectory. Even where neither of these mishaps occur, the ball often pursues a lower and shorter trajectory than if it had been hit by the sweet-spot.

Over the years, many efforts have been made to provide a means for a golfer to ascertain what area of the golf club face impacted the golf ball. After determining the point of impact and observing how much the point of impact deviates from the sweet-spot, the golfer makes whatever adjustments necessary to correct his or her swing, and tries again. U.S. Pat. No. 4,603,862 ('862 patent), U.S. Pat. No. 5,120,358 ('358 patent), U.S. Pat. No. 5,597,361 ('361 patent), U.S. Pat. No. 6,344,004 ('004 patent), and U.S. Pat. No. 6,585,604 ('604 patent) illustrate several approaches.

The '862 patent issued to Chen provides a golf ball that is permanently marked with a plurality of vertical and horizontal lines that may include special notations for yardage, a marking device comprising wooden block in which is formed recess or depression of hemispherical shape, and a chalked pad adhesively fixed to a golf club face. The golfer hits the golf ball and notes its flight. After retrieving the golf ball, the golfer determines the mark on the ball and calculates the impact point, e.g. the deviation from the sweet-spot. A disadvantage of this invention is that the ball must be retrieved before the point of impact can be determined.

The '358 patent issued to Pippett provides a flowable chalk compound, dispensed from a typical plastic squeeze tube. A dot of the flowable chalk compound is applied to one side of a conventional golf ball and the ball is positioned such that the face of a golf club will impact the ball at the dot of flowable chalk compound, which contains a hardening agent such as a gum that tends to dry or otherwise solidify when exposed to air. When the golf ball is struck by the face of a golf club at the dot of flowable chalk material, a mark forms on the club face at the point of impact. After the ball is hit, the golfer surveys the club face to determine whether the mark covers the sweet-spot. If not, the golfer adjusts his or her swing and tries again. A disadvantage of this invention is that a thick pasty residue is left on the club face from the flowable chalk compound. This residue must be wiped away with a cloth and can clog the grooves on the club face resulting in compromised ball action. Another disadvantage is that in order to apply the flowable chalk compound to a golf ball, both the ball and the dispenser must be handled simultaneously.

The '361 patent issued to Hope provides an adhesive backed appliqué which is affixed to the face of a golf club. When the club face is struck against a golf ball, the appliqué gives some indication of the strike point. A significant disadvantage, however, is that the appliqué covers the face of the club and thus obstructs the view of the club's actual sweet spot, which may be bigger or smaller than indicated by the appliqué. Another disadvantage of using an appliquéis that the club face itself never actually touches the ball. This can detrimentally affect the spin, and therefore the flight of the ball. Another disadvantage is that after five or six balls have been struck, the appliqué must be replaced because the marks on the appliqué left by previous ball strikes overlap and obscure locations of subsequent strikes.

The '004 patent issued to Adams provides a golf tee coated with colored coatings that when struck with a golf club leave a marking that easily identifies the point of impact. Specifically, the tee leaves a multicolored marking on the club face that is used to show the swing path of a golfer's swing and the point of impact of the tee on the face of the golf club. A disadvantage of this invention is that the face of a golf club may not impact the golf tee, and thus no indication of the point of impact would be given.

The '604 patent issued to Morrone provides an single piece of semi-stationary apparatus for golfers who want to exercise, self-teach, or teach the golf swing without actually sending a golf ball flying. Upon impact with the club face, the ball section of the apparatus ejects a material that marks the face of the golf club and shows the golfer where he or she hit the ball. A disadvantage is that this invention does not permit the hitting of conventional golf balls.

SUMMARY

A golf practice device is disclosed. In an embodiment, the golf practice device includes a first upper part and a second lower part. A hinge assembly rotatably connects the first upper part and the second lower part. The first upper part includes an interior sized to removably receive a golf ball for marking a center line on the ball. The second lower part has a base and includes an interior. A compressed dry powder, such as chalk, to mark the golf ball is contained within the interior of the second lower part.

BRIEF DESCRIPTION OF THE DRAWINGS

The present invention is illustrated by example and not limitation in the figures of the accompanying drawings, in which like references indicate similar elements and in which.

Figure 1:
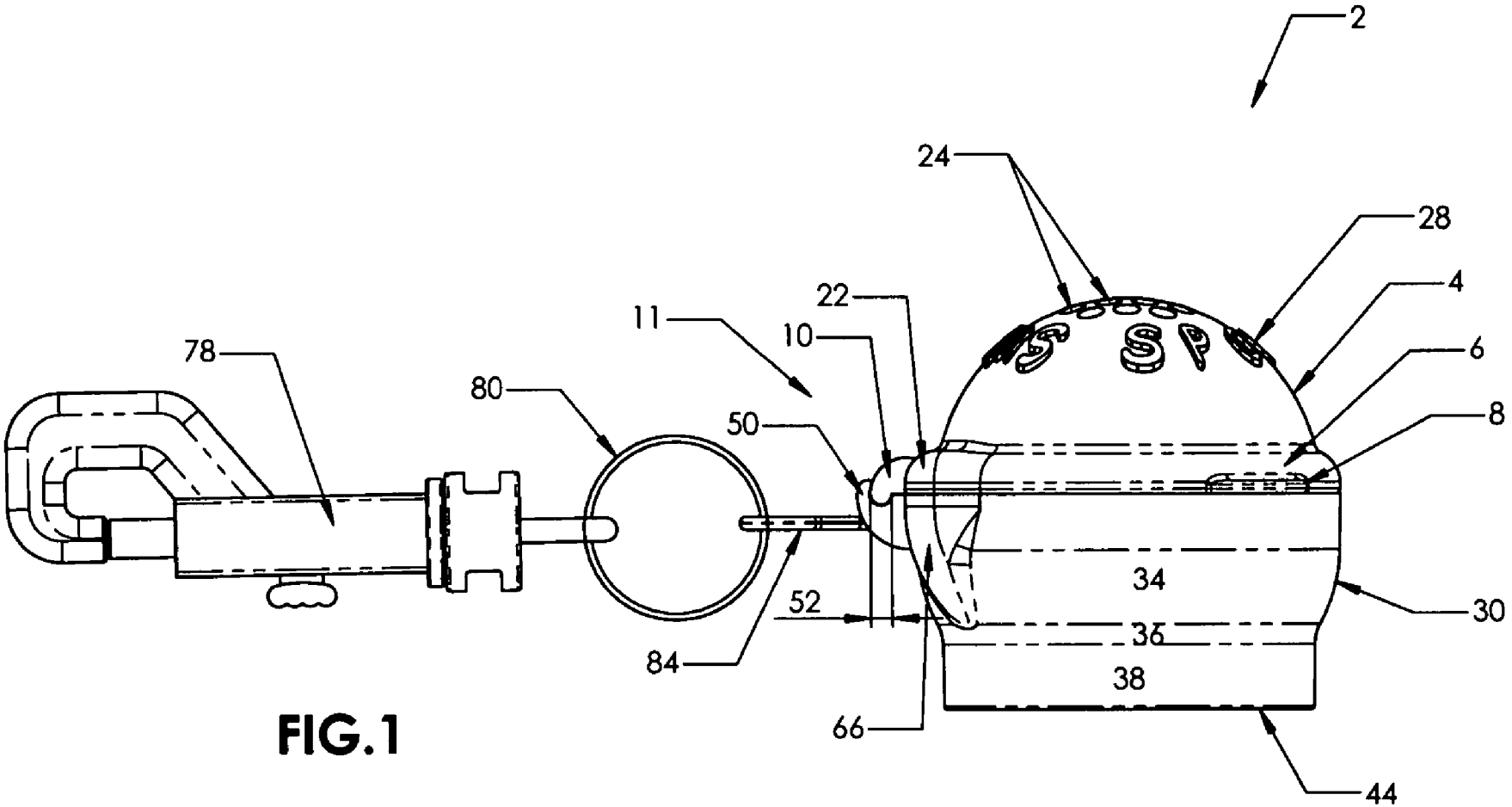
FIG. 1 is a side view of an embodiment of a golf practice device in a first closed position.

While the design is subject to various modifications and alternative forms, specific embodiments thereof have been shown by way of example in the drawings and will herein be described in detail. The design should be understood to not be limited to the particular forms disclosed, but on the contrary, the intention is to cover all modifications, equivalents, and alternatives falling within the spirit and scope of the design.

DETAILED DESCRIPTION

In the following description, numerous specific details are set forth, such as examples of external surfaces, named components, connections between components, etc., in order to provide a thorough understanding of the present design. It will be apparent, however, to one skilled in the art that the present design may be practiced without these specific details. In other instances, well known components or methods have not been described in detail but rather in a block diagram in order to avoid unnecessarily obscuring the present design. Further specific numeric references such as a first open position, may be made. However, the specific numeric reference should not be interpreted as a literal sequential order but rather interpreted that the first open position is different than a second open position. Thus, the specific details set forth are merely exemplary. The specific details may be varied from and still be contemplated to be within the spirit and scope of the present invention.

The term "golf ball," as used herein, refers to conventional golf balls and to those balls that simulate golf balls. The term "chalk," as used herein, refers to conventional chalk and to those chalklike substances and compounds that simulate chalk, such as compressed talcum powder, or something similar that leaves a dust mark on the face of the golf club after making contact with the face of the golf club. The term "chalk" also encompasses and includes the term "flowable chalk substance," and vice versa.

FIG. 1 is a side view of an embodiment of a golf practice device in a first closed position. In the embodiment shown, the golf practice device 2 includes an upper part 4 rotatably connected to the a lower part 30 via the hinge assembly 11, which includes an upper hinge 10 formed as part of the upper part 4, and a lower hinge 50 formed as part of the lower part 30. Upper hinge 10 rotates within a channel 52 created in the lower hinge 50.

In an embodiment, the exterior and interior of the upper part 4 are substantially hemispherically shaped, and latch 8 is formed in an area of the upper part 4 that is substantially opposite the upper hinge 10. A portion of latch 8 protrudes from the exterior of the upper part 4 as shown, and a portion of latch 8 protrudes substantially downwards to removably snap-fit upper part 4 to the lower part 30.

In the embodiment shown, latch 8 connects to the crown 6, which encircles the lower portion of upper part 4. The upper part 4 further includes rounded upper shoulders 22, which bulge slightly radially outwards from side portions of upper part 4 adjacent the upper hinge 10. In similar fashion, the rounded lower shoulders 66 bulge slightly radially outward from side portions of lower part 30 adjacent the lower hinge 50. When the upper part 4 is snap-fitted to the lower part 30, the upper shoulders 22 fit substantially adjacent the lower shoulders 66 as shown.

In an embodiment, the lower part 30 includes a cylindrical base 38, whose bottom surface 44 may rest on a supporting object such as the ground, a hand, a table or chair, or other suitable supporting surface. Cylindrical base 38 connects to neck 36, which connects to meridian 34, which connects to waist 32. A plurality of spherical depressions 24 and/or a plurality of letters 28 are formed on exterior or interior surfaces of the golf practice device 2 in the pattern 26 and arrangement shown in FIGS. 1 and 2. Thus, indicia markings on the exterior surface on both the upper half and the lower half may exist that are identifiable with a unique entity. The indicia markings, such as a corporate logo, sponsor's trademark, etc., on the exterior surface of the golf practice device may be made by engraving, embossing, molding, printing, etc. In another embodiment, golf practice device 2 is formed without any spherical depressions 24 or letters 28 on its exterior or interior surfaces. As later shown in FIGS. 4 and 9, the interior 56 of the lower part 30 is substantially hemispherically-shaped to contain chalk 58.

The golf practice device has an insertable retainer ring 84 with a loop protruding from the circumference of the retainer ring 84. A spring clip 78 attaches to a key ring 80 that attaches to the loop of the retainer ring to allow the golf practice device to be easily clipable onto a golfer's belt, golf bag, or other easily accessible location. The insertable retainer ring 84 inserts on top of the compressed powder to hold the compressed powder in the lower half 30. The loop may protrude from this retainer ring 84. Alternatively, the loop for that the key ring 80 attaches to may protrude from the body of the lower half 30 of the golf practice device. The insertable retainer ring 84 may be composed of a plastic having a high elasticity value, such as polypropylene at 217,000-290,000 pounds of force per square inch ($lbf/in^2$).

Figure 2:
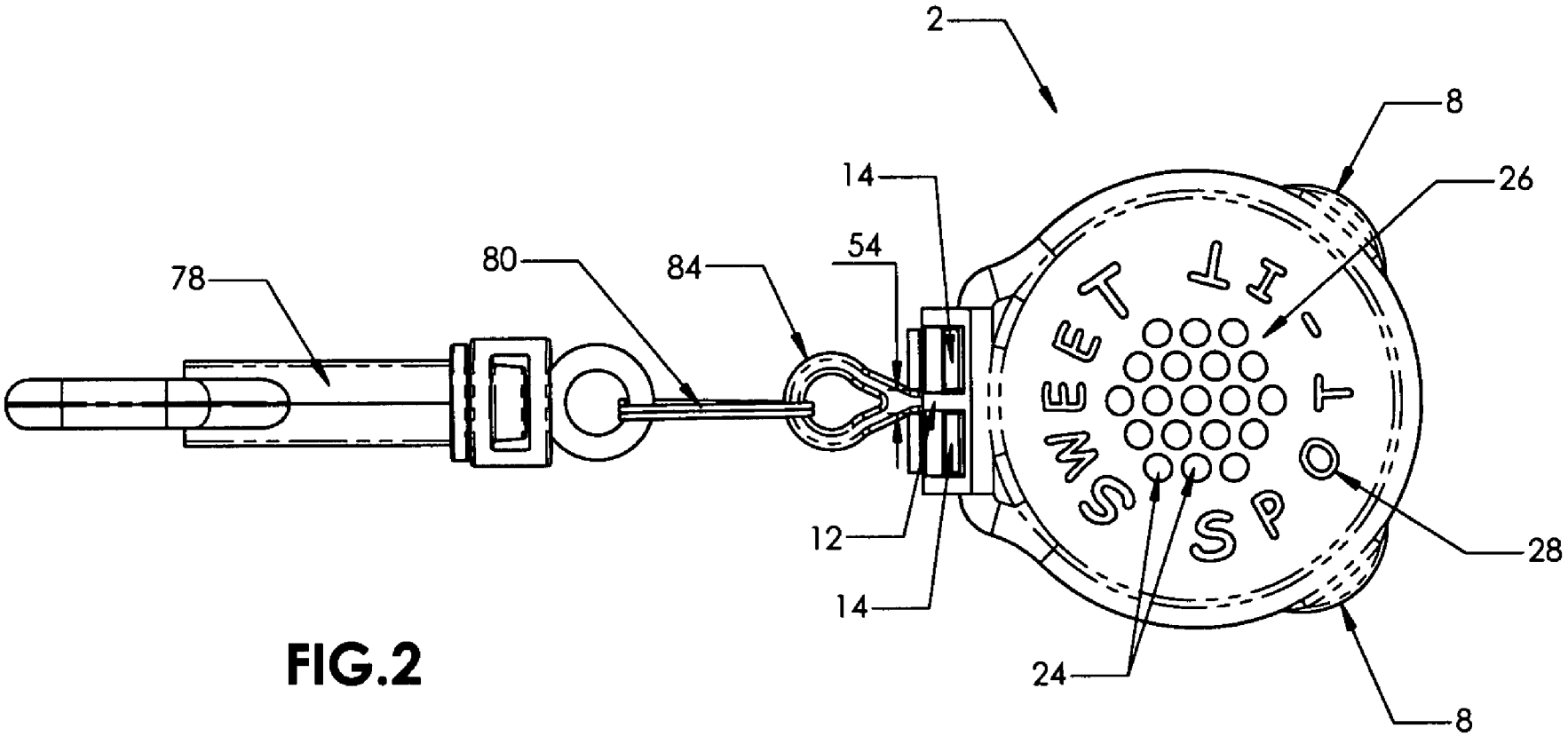
FIG. 2 is a top view of an embodiment of the golf practice device of FIG. 1.

FIG. 2 is a top view of an embodiment of the practice device 2 shown in FIG. 1. As in FIG. 1, the golf practice device is depicted in the first closed position. The top-down perspective of FIG. 2 illustrates the rectangular-shaped openings 14 and brace 12 that are formed in the upper hinge 10. The brace 12 connects substantially perpendicularly to a portion of the upper hinge 10 that rotatably fits within the channel 52 created in the lower hinge 50. When the upper part 4 is moved to the second open position shown in FIG. 4, the brace 12 removably fits within the notch 54 formed in the lower hinge 50. On the back side of the golf practice device, the insertable retainer ring 84 extends to the key ring 80. On the front side of the golf practice device, two tabs 8 extend from the exterior of the upper part 4. The two or more thumb tabs 8 protruding from the upper part 4 of the golf practice device assist in lifting the upper part 4 from the lower half 30. A latch is centered in the golf practice device and each thumb tab 8 is located off of the centerline of the golf practice device.

Figure 3:
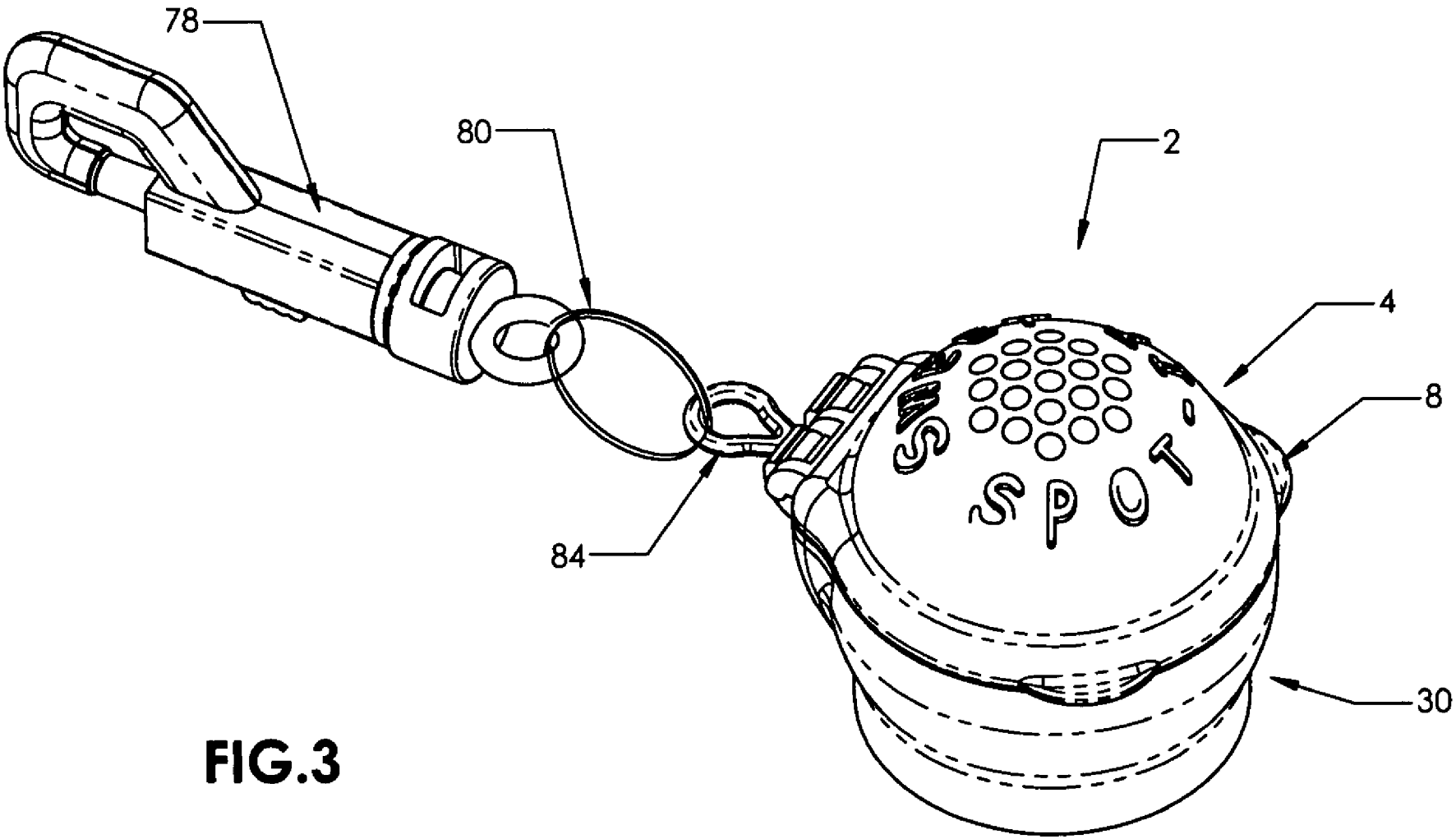
FIG. 3 is a perspective view of an embodiment of the golf practice device of FIGS. 1 and 2 showing the golf practice device in the first closed position.

FIG. 3 is a perspective view of an embodiment of the practice device shown in of FIGS. 1 and 2 showing the golf practice device in the first closed position. This figure better illustrates hinge assembly 11 and depicts the practice device 2 in the first closed position shown in FIGS. 1 and 2, where the hinge 8 removably snap-fits the upper part 4 to the lower part 30.

Figure 4:
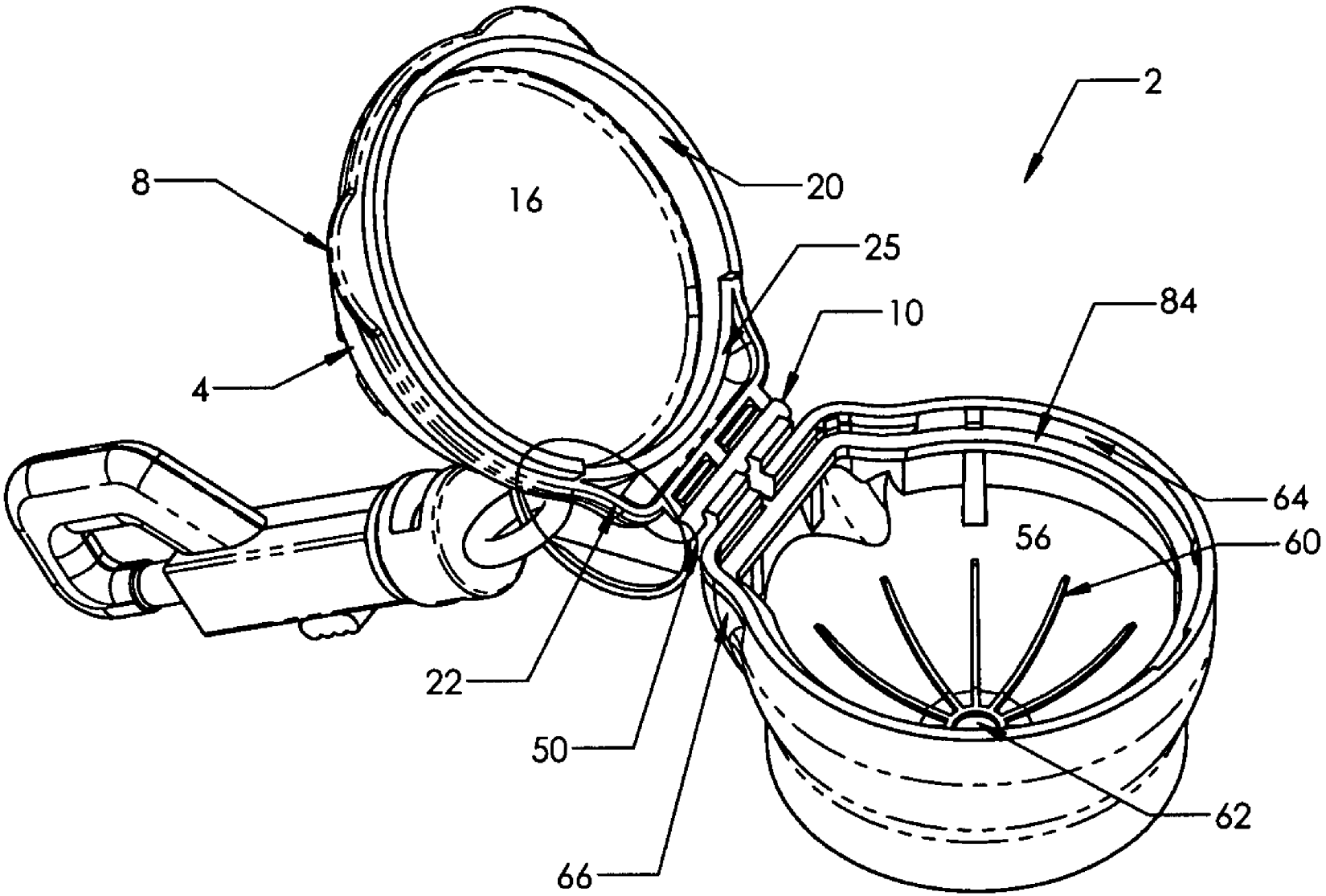
FIG. 4 is a perspective view of an embodiment of the golf practice device of FIG. 3 showing the golf practice device in a first open position.

FIG. 4 is another perspective view of an embodiment of the golf practice device 2 and shows the golf practice device 2 in a first open position. In the first open position, upper part 4 is rotated upwards and backwards approximately or less than 180 degrees from the first closed position, previously shown in FIGS. 1-3. Also shown are the interiors 16 and 56 of the upper part 4 and the lower part 30, respectively. In the embodiment shown, interior 16 and interior 56 are substantially hemispherically-shaped. Interior 56 is strengthened by the placement of radial ribs 60, which arc upwards along the inner surface of interior 56 and connect to a central bottom circular rib 62. The radial ribs 60 and central bottom circular rib also promote adhesion of chalk 58 (shown in FIG. 9) within the lower part 30. The radial ribs 60 help prevent the compressed power in block form from rotating freely in the plastic lower part 30 when a user is rubbing their golf ball into the block of compressed power. Interior rim 64 corresponds to the outer waist 32 shown in FIG. 1. Also, the interior 56 of the lower part 30 being substantially hemispherically-shaped allows the user to obtain more chalk readings per block of compressed powder life cycle. The compressed power will naturally fall into the center of the hemisphere causing less of the block to be unused in corner portions of a container.

Referring again to FIG. 4, a rim 20 is formed on the upper part 4. The rim 20 includes edge 25, which is used to draw a line substantially near an equator (center) of a golf ball (not shown) when the golf ball is removably positioned within the interior of the upper part 4 of the golf practice device 2. The line is drawn by placing a marking device (not shown) against the edge 25 in contact with the outer surface of the golf ball, and drawing the marking device laterally along the edge 25. The marking device is removed and the golf ball is placed on the ground (or golf tee) such that the line marked on the ball's outer surface is visible to the golfer. By providing a visual reference point, the line assists a golfer in aiming the golf ball for putts or drives.

Figure 5:
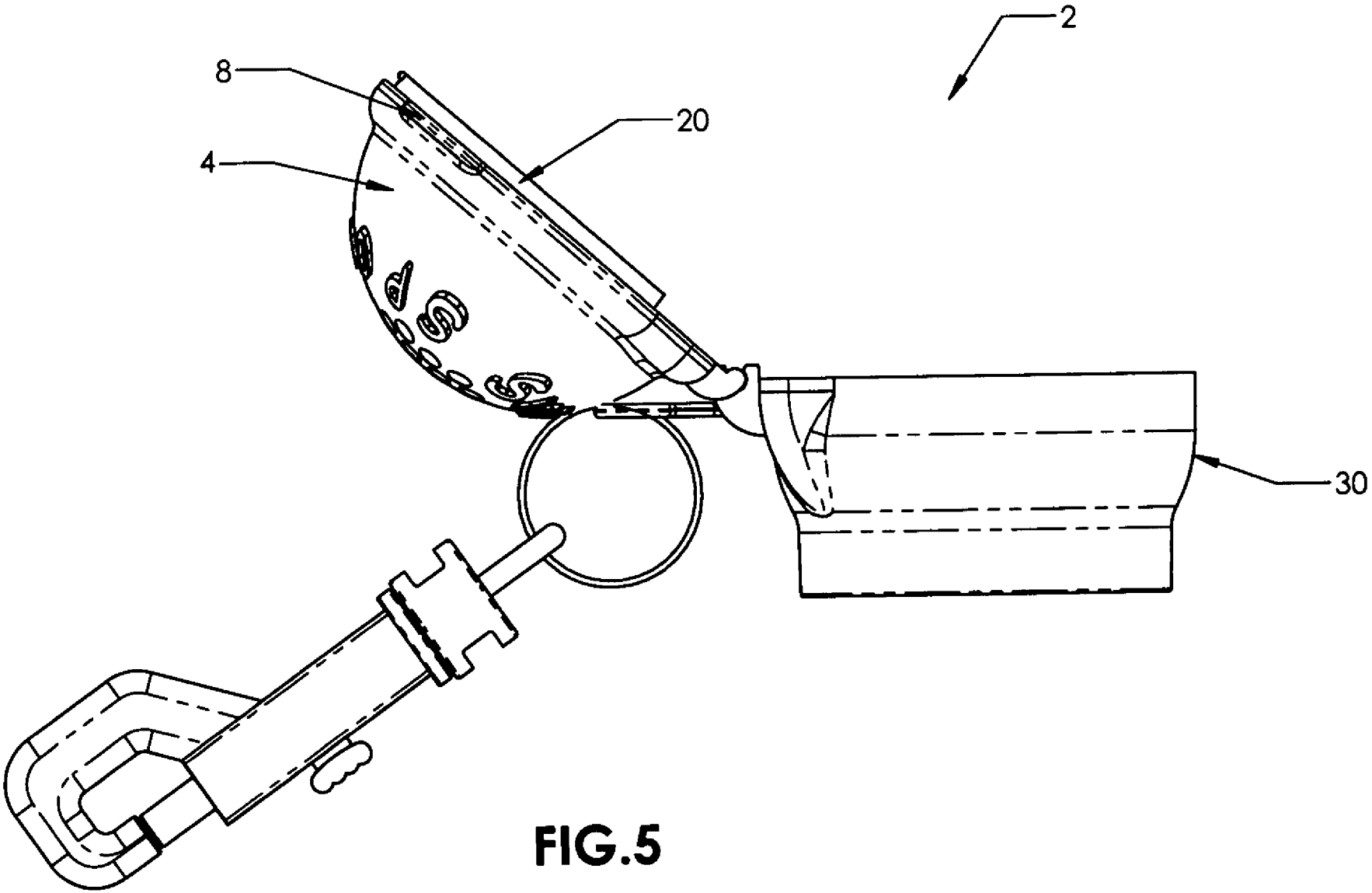
FIG. 5 is a side view of an embodiment of the golf practice device of FIG. 4 showing the golf practice device in a second open position.

FIG. 5 is a side view of an embodiment of the golf practice device 2 and shows practice device 2 in a second open position, where the upper part 4 has been rotated upwards and backwards approximately 180 degrees from the lower part 30. FIG. 5 further illustrates the placement of thumb tabs 8 and rim 20 on the upper part 4.

Figure 6:
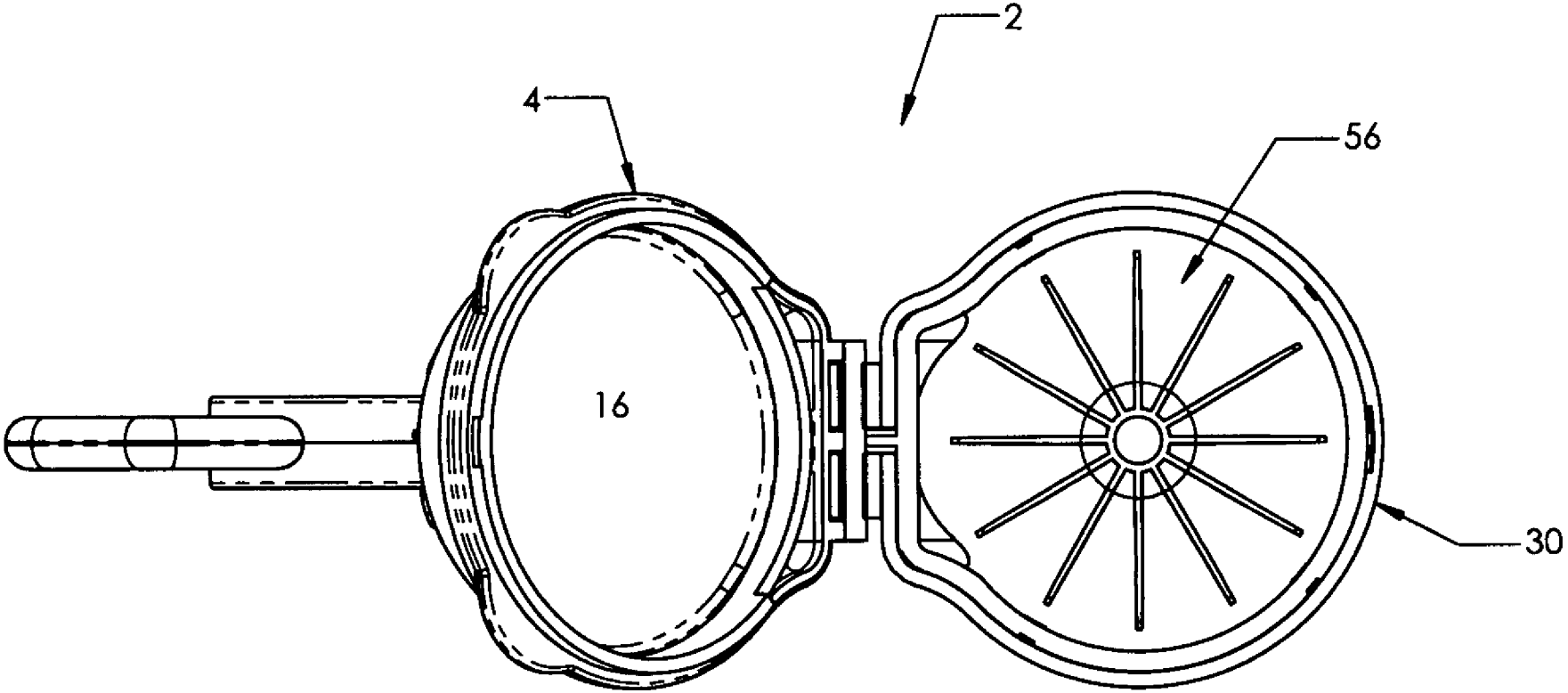
FIG. 6 is a top view of an embodiment of the golf practice device of FIG. 5.

FIG. 6 is a top view of an embodiment of the golf practice device 2 and further illustrates the interiors 16 and 56 of the upper part 4 and the lower part 30, respectively.

Figure 7:
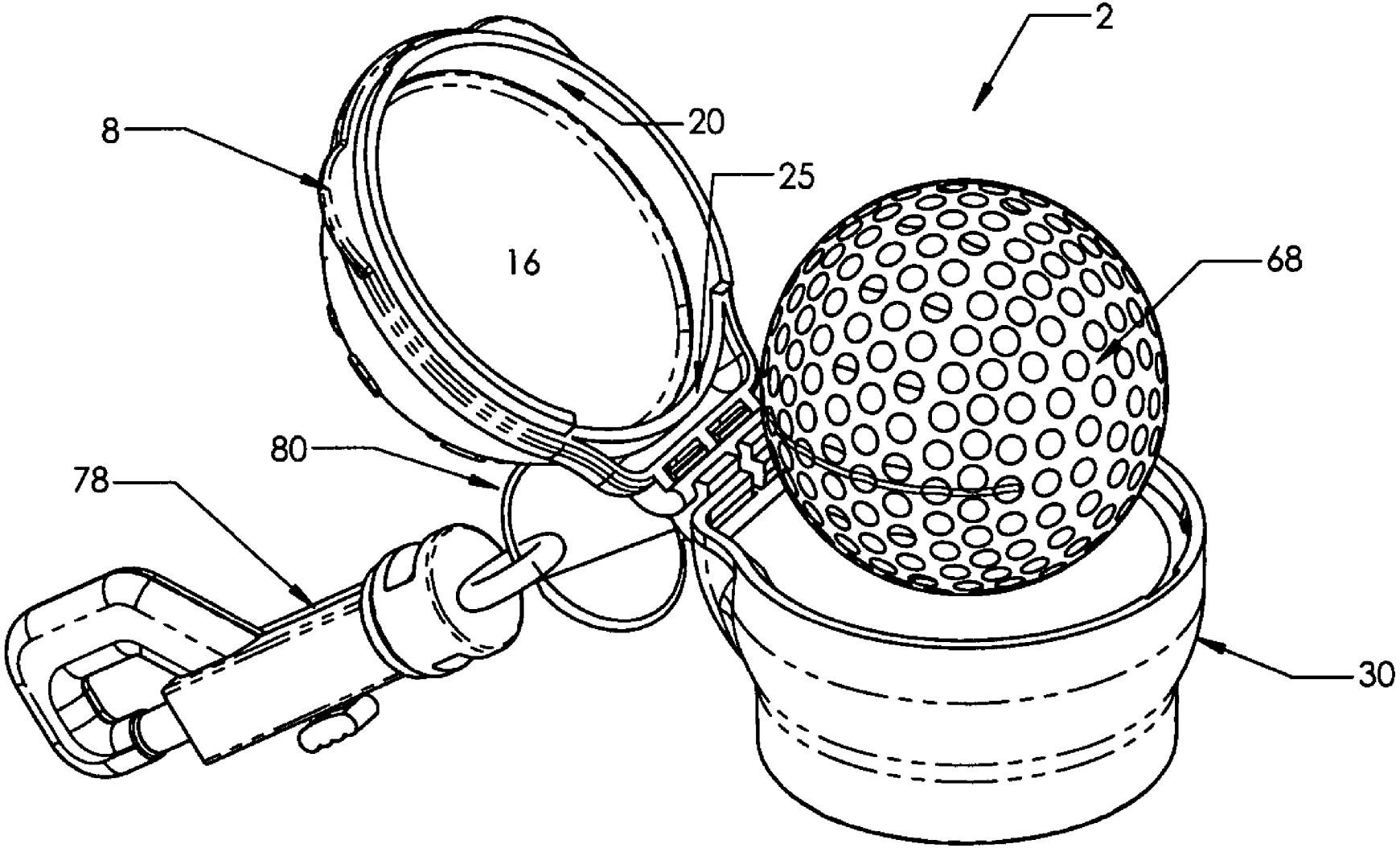
FIG. 7 is a top perspective view of an embodiment of the golf practice device of FIG. 6 showing the golf practice device in the second open position with a conventional golf ball removably inserted for marking in one part thereof.

FIG. 7 is a top perspective view of an embodiment of the golf practice device 2. In this figure, the golf practice device 2 is opened to the second open position shown in FIGS. 4 and 6, and a golf ball 68 is shown removably inserted within the interior of the lower part 30.

Figure 8:
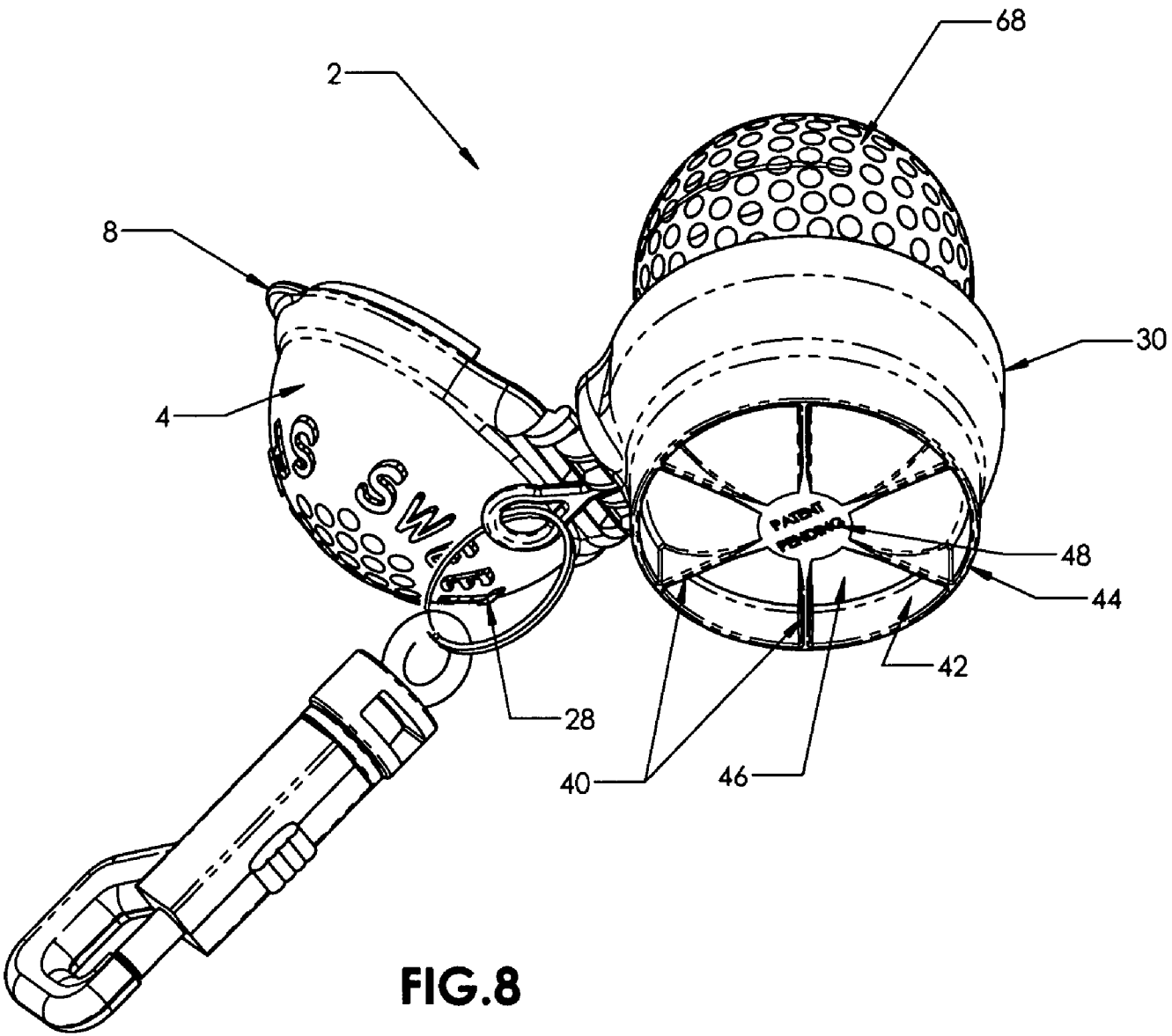
FIG. 8 is a bottom perspective view of an embodiment of the golf practice device of FIG. 7.

FIG. 8 is a bottom perspective view of an embodiment of the golf practice device 2. In this figure, the golf practice device 2 is opened to the second open position shown in FIGS. 4 and 6, and a golf ball 68 is shown removably inserted within the interior of lower part 30. Additionally, braces 40 are shown connecting the interior wall 42 of base 38. In the embodiment shown, letters 48 are shown on the exterior surface of the outer wall 46, which forms the backside of the previously depicted and described lower hemisphere 56. In an alternate embodiment, the golf practice device 2 is formed without letters or other markings.

Figure 9:
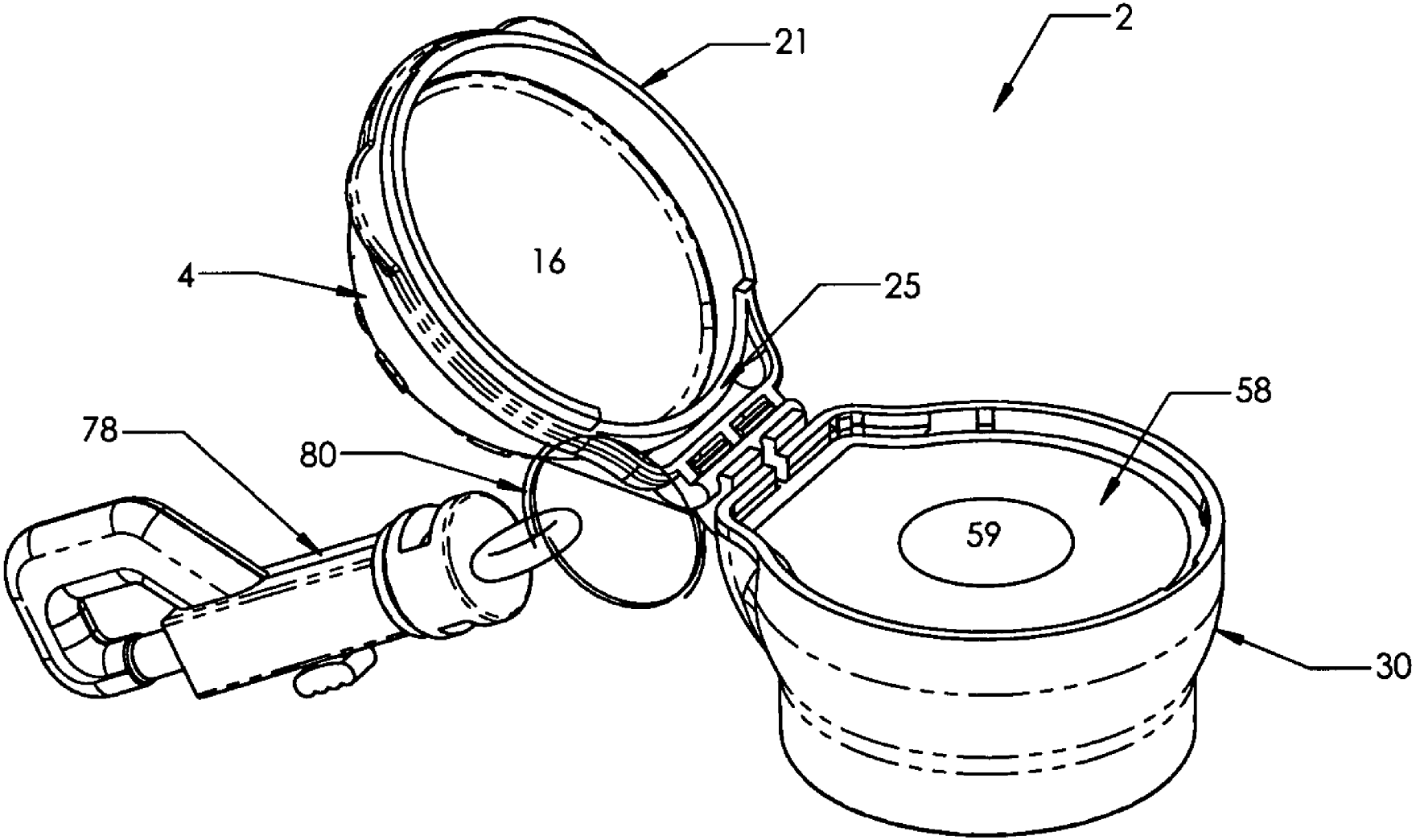
FIG. 9 is a side perspective view of an embodiment of the golf practice device of FIG. 1 showing the golf practice device in the second open position to expose a block of chalk.

FIG. 9 is a side perspective view of an embodiment of the golf practice device 2 showing the golf practice device in the second open position of FIGS. 4 and 6. As shown in FIG. 9, chalk 58 forms a rigid or semi-rigid block, which is adhered within and to the interior of the lower part 30. In an alternate embodiment, chalk 58 forms a rigid or semi-rigid block, which is press-fitted within and to the interior of the lower part 30. As shown, the chalk 58 substantially fills the interior 56 of the lower part 30 and includes a central, substantially circular, depression 59 into which a golf ball 68 (shown in FIGS. 11 and 12) may be removably and rotatably pressed.

Figure 10:
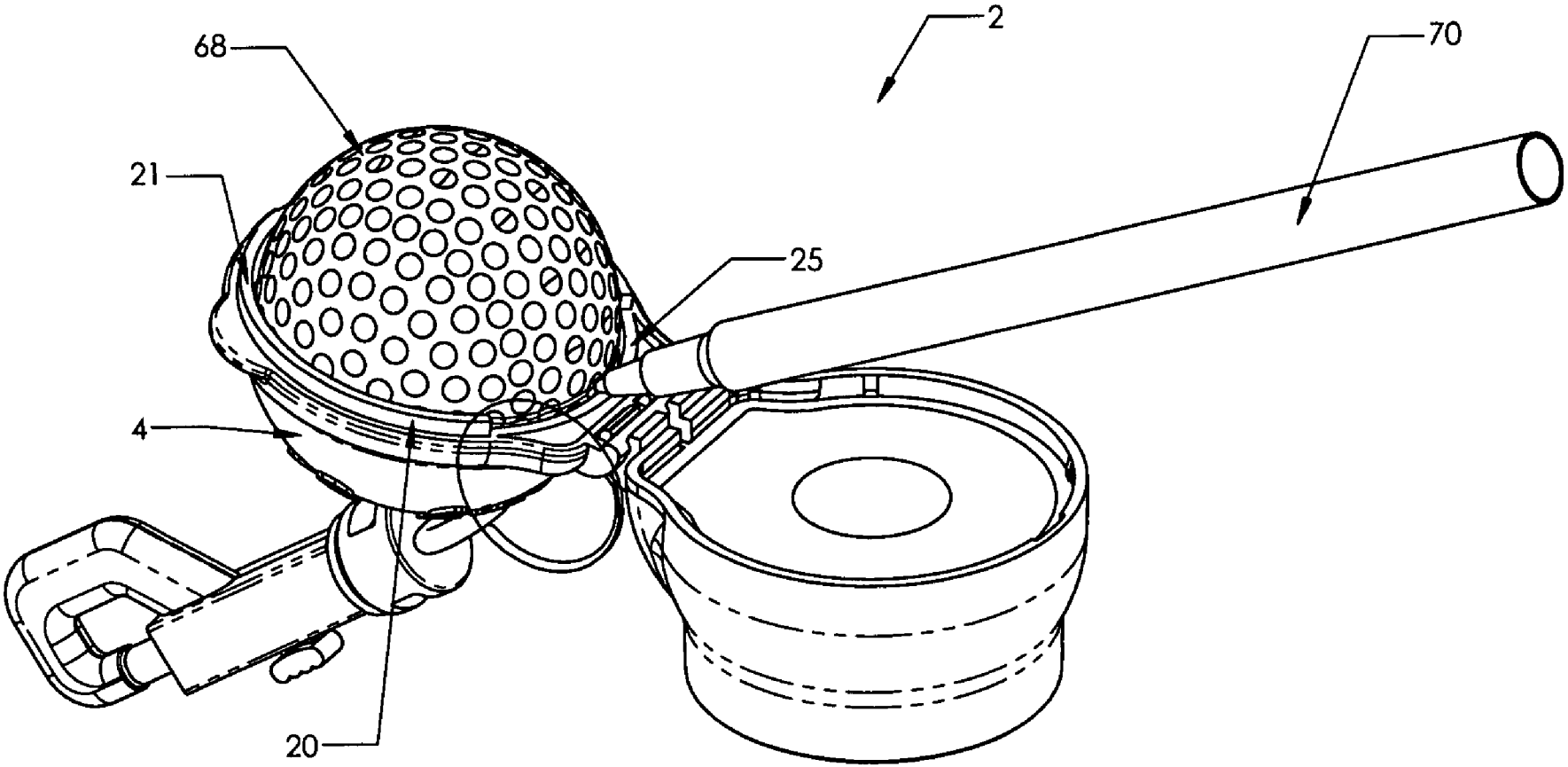
FIG. 10 is a side perspective view of an embodiment of the golf practice device of FIG. 9 showing the golf practice device in the second open position with a golf ball removably inserted in a top portion thereof, and further showing a flowable marking device contacting the golf ball and drawn along a rim formed on the upper portion to mark the golf ball near its equator.

FIG. 10 is a side perspective view of an embodiment of the golf practice device of FIG. 9 showing the golf practice device in the second open position with a golf ball removably inserted in a top portion thereof, and further showing a flowable marking device contacting the golf ball and drawn along a rim formed on the upper portion to mark the golf ball near its equator. As shown, one end of a marking device 70 is placed against an edge 25 of the rim 20 in contact with the exterior surface of a golf ball 68 removably placed within the interior of the upper part 4. The marking device 70 is then drawn laterally along the edge 25 and the exterior surface of the golf ball 68 such that a center line is formed substantially near the equator (center) of the golf ball 68. Thereafter, the marking device 70 is removed. The golf ball 68 is then taken from the interior of the upper part 4 and placed in a hitting position so that the line marked on its exterior surface is positioned substantially perpendicular to the face of a golf club (not shown) aligned to strike the golf ball 68. In an embodiment the marking device 70 is a pen or magic marker.

Figure 11:
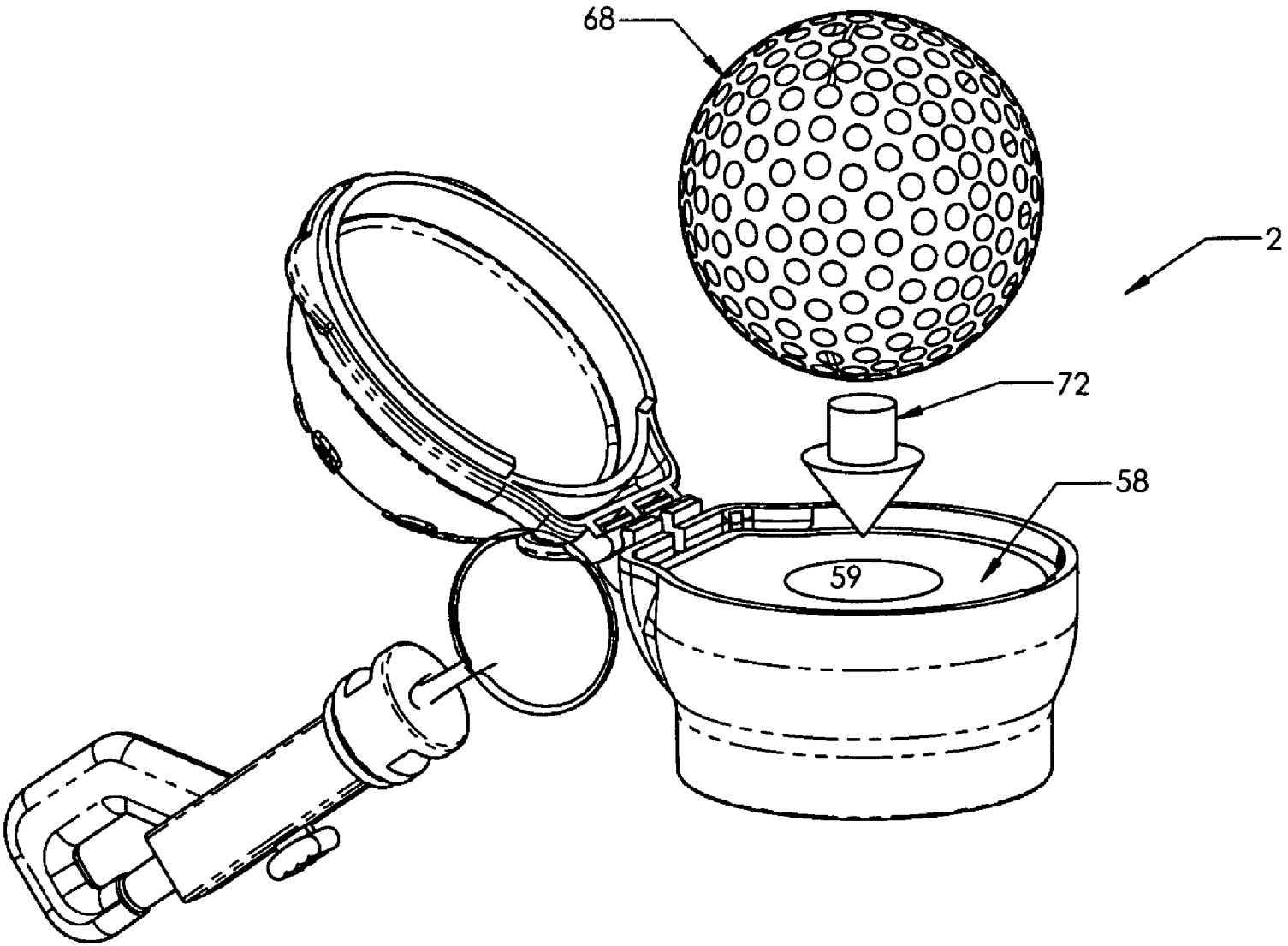
FIG. 11 is a side perspective view of an embodiment of the golf practice device of FIG. 9 showing the golf practice device in the second open position and a golf ball being placed into contact with the block of chalk.
Figure 12:
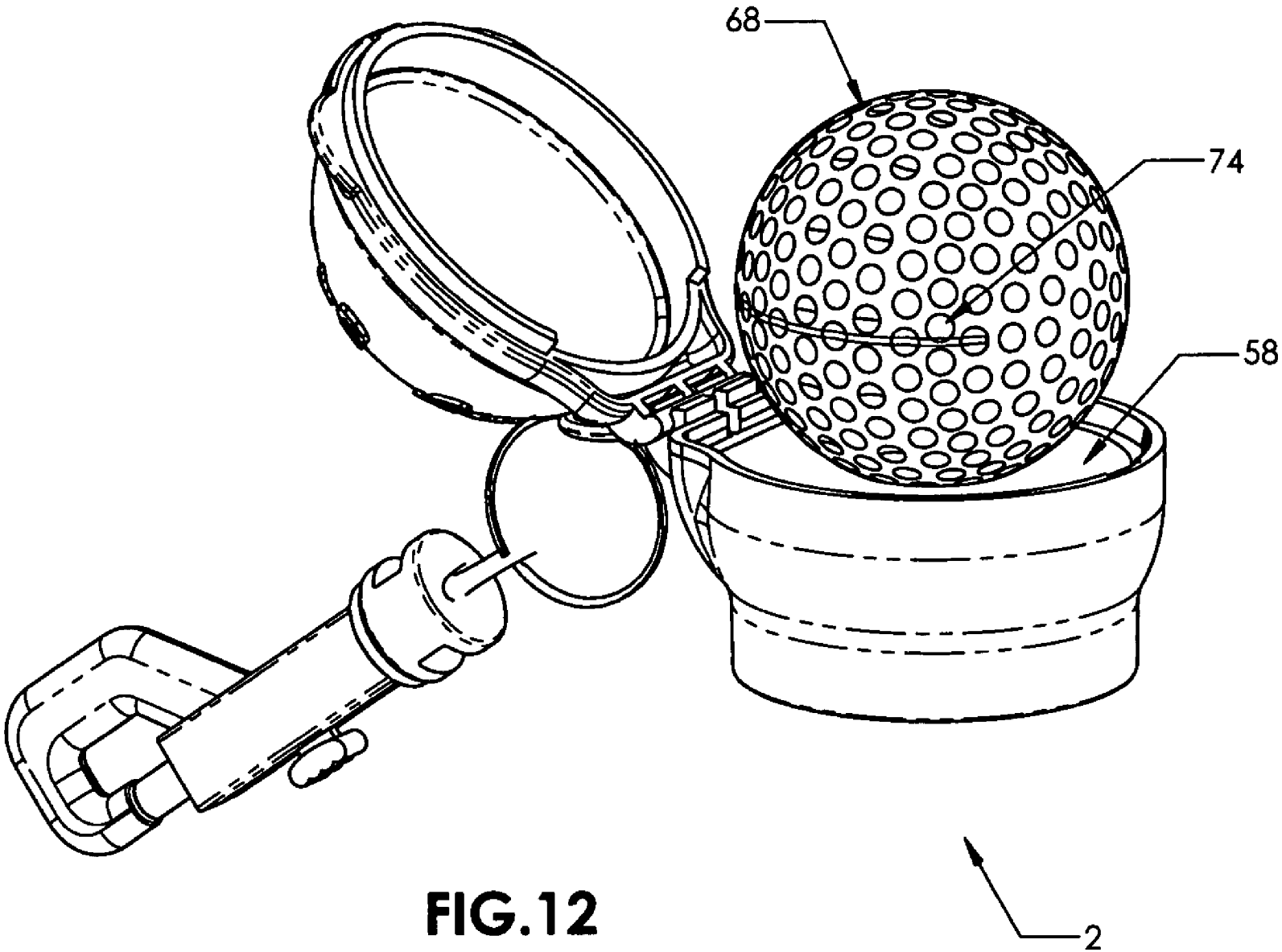
FIG. 12 is a side perspective view of an embodiment of the golf practice device of FIG. 11 showing the golf ball being pressed into contact with the block of chalk and rotated from side-to-side to mark a portion of the golf ball with a layer of chalk.

FIG. 11 is a side perspective view of an embodiment of the golf practice device of FIG. 9 showing the golf practice device in the second open position and a golf ball being placed into contact with the block of chalk. FIG. 12 is a side perspective view of an embodiment of the golf practice device of FIG. 11 showing the golf ball being pressed into contact with the block of chalk and rotated from side-to-side to mark a portion of the golf ball with a layer of chalk. In use, the upper part 4 is separated from the lower part 30 and rotated upward and backward to the second open position shown in FIG. 11. A golf ball 68 is positioned above the chalk 58 contained within the lower part 30 and moved, in the direction of arrow 72, towards an upper surface of the central, substantially circular-shaped, depression 59 formed in the chalk 58. Once the golf ball 68 contacts the chalk 58, as shown in FIG. 12, the golf ball 68 is lightly pressed into the chalk 58 and rotated side-to-side, in the directions of arrow 74, to coat a section of the golf ball 68 with a thin coating of chalk 58. In an embodiment, the golf practice device 2 is held in one of a user's hands and the golf ball 68 is held with the fingers of the user's other hand. Alternatively, the golf ball 68 is held with the fingers of one of a user's hands and the golf practice device 2 is situated in the second open position described above with its base resting on the ground or other supporting object. The golf ball 68 is then brought into contact with the chalk 58 that is positioned within the golf practice device 2.

Once marked with chalk 58, the golf ball 68 is placed in such a position that its chalk-covered portion will impact a face of a golf club swung by a golfer. When struck by the club face, the chalk-covered portion of the golf ball 68 imprints a mark on the face of the golf club that shows the point of impact. After completing the swing, a golfer observes the face of the golf club and determines, from the position of the chalk mark, whether the club's sweet-spot hit the ball or not. Thereafter, the golfer erases the chalk mark by wiping the club face with a hand, cloth, or other item, marks another golf ball using the golf practice device 2 in the manner described above, adjusts his or her technique, and tries again. It is estimated that over 1000 golf balls can be marked before the chalk 58 contained in the lower part 30 is used up. The compressed powder form combined with the hemispherically-shaped interior of the lower portion 30 allows the user to obtain these 1000 plus readings of an indication of the point of contact between the golf ball and the golf club.

In the embodiments described above, the chalk 58 used to mark the golf ball 68 is a paste or powder formed into a rigid or semi-rigid block (or marking layer) whose shape conforms to the boundaries of the interior 56 of the lower part 30. The chalk 58 is formed of such ingredients and adhered to (or fitted within) the interior 56 of the lower part 30 such that it marks a portion of the golf ball 68 without detaching the remainder of the chalk 58 from the interior 56 of the lower part 30 when the golf ball 68 is removed. Adhesion may be accomplished using adhesives known to persons skilled in the art or by press-fitting the chalk 58 into the interior 56 of the lower part 30 of the golf practice device 2. A pigment or pigments of virtually any color and luminosity may be added to the chalk 58 to give it a desired coloration and appearance. A filler or fillers may be added to the chalk 58 to give it a desired texture and/or consistency.

In the embodiments described above, the golf practice device 2 is formed of injection molded plastic, such as ABS or HIPS (High Impact Polystyrene).

In an alternate embodiment, the chalk 58 used to mark the golf ball 68 is a paste or powder formed into a rigid or semi-rigid block (or marking layer) whose shape conforms to the boundaries of the interior 16 of the upper part 4. The chalk 58 is formed of such ingredients and adhered (or fitted within) the interior 16 of the upper part 4 such that it marks a portion of the golf ball 68 without detaching the remainder of the chalk 58 from the interior 16 of the upper part 4 when the golf ball 68 is removed. Adhesion may be accomplished using adhesives known to persons skilled in the art or by press-fitting the chalk 58 into the interior 16 of the upper part 4 of the golf practice device 2.

The golf practice device is easily recycled for another use cycle by replenishing the powder. In block compressed power form, the retaining ring may be removed. A new block of compressed powder may be inserted and the retaining ring may be reinstalled.

The chalk on the face of the golf club to indicate where the ball and the face of the golf club contact appears on and remains on the face of the golf club after that contact has been made. Therefore, no need exist to retrieve the golf ball at a golf ball driving range or retrieve the golf ball at all to determine how and where the ball to face of golf club occurred.

Further, the point of contact indication being made by a compressed dry powder does not adversely effect an action of the impact of the golf club on a flight of the golf ball. The compressed powder does not adversely effect the golf club's action on the golf ball to control the flight of the golf ball unlike a sticky adhesive or a slick band of tape. A sticky adhesive can both adhere to the face of the golf club and adversely effect the friction grip of the surface of the golf club on the golf ball, as well as adhere to the ball and effect the rotation of the ball. A band of tape with a smooth surface inserted between the face of the golf club and the golf ball can adversely effect the friction grip of the surface of the golf club on the golf ball. In contrast, the dry powder actually acts to increase the friction grip between the face of the golf club and the golf ball.

The compressed power does not diminish the golf clubs action on the golf ball to control the flight of the golf ball.

The foregoing description and drawings are given for illustrative purposes only. For example, a single thumb tab may be located on the centerline of the golf practice device rather than two offset tabs. The invention claimed, depicted, and described herein is not limited to the embodiments disclosed, but rather embraces any and all alternatives, equivalents, modifications, and rearrangements of elements or steps falling within the scope of the invention as defined by the following claims.

What is claimed is:

1. A golf practice device, comprising:

an upper part, the upper part having an interior sized to removably receive a golf ball for marking a centerline on the ball;

a lower part, the lower part having a base and having an interior;

a hinge assembly rotatably connecting the upper part to the lower part;

a compressed powder to mark the golf ball, the compressed powder contained within the interior of the lower part, and an insertable retainer ring with a loop protruding from the circumference of the ring, wherein the insertable retainer ring inserts on top of the compressed powder to hold the compressed powder in the lower half.

2. The golf practice device of claim 1, wherein the insertable retainer ring of the golf practice device is composed of a plastic having an elasticity value equal to or better than polypropylene.

3. The golf practice device of claim 1, wherein the interior of the lower part is substantially hemispherical in shape.

4. The golf practice device of claim 1, further comprising:

indicia markings on the exterior surface of at least one of the upper half and the lower half of the golf practice device that are identifiable with a unique entity.

5. The golf practice device of claim 1, wherein the compressed powder is chalk.

6. The golf practice device of claim 5, wherein the chalk is composed of pigments to give the chalk powder a fluorescent quality.

7. The golf practice device of claim 1, wherein the compressed powder is a different color than a color of a white golf ball.

8. The golf practice device of claim 1, wherein the upper part and lower part are formed from an injection molding process.

9. A golf practice device, comprising:

an upper part, the upper part having an interior sized to removably receive a golf ball for marking a centerline on the ball;

a lower part, the lower part having a base and having an interior;

a hinge assembly rotatably connecting the upper part to the lower part; and a compressed powder to mark the golf ball, the compressed powder contained within the interior of the lower part, wherein the interior of the lower part has a plurality of radial ribs which arc upwards along the inner surface of interior and connect to a central bottom orifice.

10. A golf practice device, comprising:

an upper part, the upper part having an interior sized to removably receive a golf ball for marking a centerline on the ball;

a lower part, the lower part having a base and having an interior;

a hinge assembly rotatably connecting the upper part to the lower part;

a compressed powder to mark the golf ball, the compressed powder contained within the interior of the lower part; and a stepped flange around a rim of the upper half having a recessed portion to allow the marking of the centerline on the golf ball.

11. The golf practice device of claim 10, wherein the recessed portion is located on the upper half in relation to an inserted golf ball to have an edge of the recessed portion laterally run along an equator center line of the golf ball.

12. The golf practice device of claim 11, further comprising:

two or more thumb tabs protruding from the upper part; and a latch, wherein the latch is centered in the golf practice device and each thumb tab located off of the centerline of the golf practice device.

13. The golf practice device of claim 12, wherein the bottom portion of the lower part is substantially cylindrical in shape.

14. An apparatus, comprising:

means for receiving a golf ball into a portion of a golf ball marking device;

means for supporting the golf ball on top of a compressed powder;

means for identifying a centerline on the ball;

means for making an erasable marking from the compressed powder on an exterior of a golf ball to transfer at least a portion of the erasable marking to a face of a golf club when contact is made between the golf ball and the golf club; and means for gripping a block of the compressed powder in place with radial ribs of a lower part of the golf ball marking device to assist the block in resisting turning when the erasable marking on the exterior of the golf ball is made from contact with the compressed powder.

15. The apparatus of claim 14, wherein the means for making the erasable marking from the compressed powder on the face of the golf club to indicate a point of contact where the golf ball contacts the face of the golf club.

16. The apparatus of claim 14, wherein the means for identifying the centerline to align an edge of the golf ball marking device to allow a user to draw a line laterally along an equator centerline of the golf ball.

17. The apparatus of claim 14, wherein the compressed power is chalk.

18. The apparatus of claim 14, wherein the means for making the erasable marking from the compressed powder on the exterior of the golf ball to make marks at least up to one thousand times from a block of compressed powder prior to replenishing the block of compressed powder for another use cycle.

* * * * *